US005989729A

United States Patent [19]

Takagi et al.

[11] Patent Number: 5,989,729

[45] Date of Patent: Nov. 23, 1999

[54] WEAR RESISTANT METAL COMPOSITE

[75] Inventors: Katumi Takagi, Nagoya; Shuji Inoue, Anjo, both of Japan

[73] Assignee: Aisin Seiki Kabushiki Kaisha, Kariya, Japan

[21] Appl. No.: 08/960,193

[22] Filed: Oct. 29, 1997

[30] Foreign Application Priority Data

Nov. 21, 1996 [JP] Japan ..... 8-327897

[51] Int. Cl.[6] ..... B21D 39/00

[52] U.S. Cl. ..... 428/614; 428/650; 428/552

[58] Field of Search ..... 428/469, 472.2, 428/545, 613, 614, 650, 654, 549, 551, 552, 548; 164/91, 97, 98

[56] References Cited

U.S. PATENT DOCUMENTS

| | | | |
|---|---|---|---|
| 4,444,603 | 4/1984 | Yamatsuta et al. | 148/549 |
| 4,489,138 | 12/1984 | Yamaysuta et al. | 428/614 |
| 4,526,841 | 7/1985 | Yamatsuta et al. | 428/614 |
| 4,547,435 | 10/1985 | Yamatsuta et al. | 428/614 |
| 4,888,054 | 12/1989 | Pond, Sr. | 75/234 |
| 4,946,647 | 8/1990 | Rohatgi et al. | 420/528 |
| 4,963,439 | 10/1990 | Yammoto et al. | 428/614 |
| 4,980,242 | 12/1990 | Yamamoto et al. | 428/614 |
| 5,228,494 | 7/1993 | Rohatgi | 164/97 |
| 5,514,480 | 5/1996 | Takagi et al. | 428/549 |
| 5,711,362 | 1/1998 | Rohtagi | 164/97 |

FOREIGN PATENT DOCUMENTS

| | | |
|---|---|---|
| 0 624 657 | 11/1994 | European Pat. Off. . |
| 6-322459 | 11/1994 | Japan . |
| WO 97/19775 | 6/1997 | WIPO . |

OTHER PUBLICATIONS

J. Falbe, et al., Georg Thiem Verlag, pp. 1396–1397,"Rompp Chemie Lexikon", 1990.

W. Gerhartz, et al., Ullmann's Encyclopedia of Industrial Chemistry, vol. A 5, pp. 502–504, "Cement and Concrete", 1986.

*Primary Examiner*—Timothy Speer
*Assistant Examiner*—Stephen Stein
*Attorney, Agent, or Firm*—Oblon, Spivak, McClelland, Maier & Neustadt, P.C.

[57] ABSTRACT

A wear resistant metal composite which comprises formed porous fly ash obtained by forming fly ash into the desired shape and a metal impregnated into voids present in the interior of said formed fly ash, wherein the percentage by volume of said formed fly ash is 30% by volume or less, and wherein said fly ash is exposed on the surface of said wear resistant metal composite.

5 Claims, 4 Drawing Sheets

WEAR RESISTANT METAL COMPOSITE

BACKGROUND OF THE INVENTION

1. Filed of the Invention

The present invention relates to a wear resistant metal composite which is used in a member which is required to be wear resistant such as a cylinder block, a piston and the like of an internal combustion engine.

2. Description of the Related Arts

Wear resistant metal composites have been hitherto used in a sliding part of a cylinder block of an internal combustion engine. For example, as such a wear resistant metal composite, there has been hitherto a sliding member in which a reinforcer composed of alumina short fiber and mullite particles is added to aluminium as disclosed in Laid-Open Japanese Patent Publication No. 6-322459.

In addition, in U.S. Pat. No. 5,228,494, there is disclosed a metal composite in which reinforcing particles such as graphite, fly ash, oil ash or the like is mixed into aluminium molten meal.

However, there are the following problems in the above previous wear resistant metal composites.

That is, in the former sliding member, alumina short fiber and mullite particles have the higher cost. For this reason, it is difficult to manufacture wear resistant metal composites at the lower cost.

In addition, in the latter metal composite, aluminium molten metal containing reinforcing particles is cast into a mold and, at the same time, this is required to be stirred so as not to cause the concentration difference of the reinforcing particles due to their precipitation at casting. For this reason, operations at melting become complicated.

Further, there is a method for reinforcing whole metal composite according to a method disclosed in U.S. Pat. No. 5,228,494. However, in this case, unnecessary parts of a metal composite must be processed, which leads to difficult cutting.

SUMMARY OF THE INVENTION

In view of such the previous problems, an object of the present invention is to provide a wear resistant metal composite which has excellent wear resistance and can be prepared at the lower cost.

The present invention is a wear resistant metal composite which comprises formed porous fly ash obtained by forming fly ash into the desired shape and a metal impregnated in voids present in the interior of said formed fly ash, wherein said fly ash is exposed on the surface.

The wear resistant metal composite of the present invention utilizes fly ash. In particular, the present invention can contribute to recycle or energy conservation by utilizing fly ash which is an industrial waste.

That is, the wear resistant metal composite is formed fly ash obtained by forming fly ash, in which a metal is impregnated in the interior of said formed fly ash. In addition, fly ash is a hard material. Therefore, by impregnating a metal in the interior of formed fly ash while maintaining the skeleton of formed fly ash, fly ash can be arranged at the desired position, in comparison with a case where powdery fly ash is added to a metal. In particular, by exposing fly ash on the sliding surface of the metal composite, wear resistance of the metal composite can be remarkably improved.

For this reason, strength of the metal composite is enhanced by formed fly ash and its wear resistance is also improved. Therefore, when the metal composite is used on the sliding surface, the excellent wear resistance can exert. Accordingly, strength and wear resistance of the metal composite can be remarkably improved as compared with a case where fly ash in the powder form is added to a metal without forming.

According to the present invention, there can be provided a wear resistant metal composite which has excellent wear resistance and can be manufactured at the lower cost.

DETAILED DESCRIPTION OF THE INVENTION

The formed fly ash may have the same shape as that of the wear resistant metal composite or may have smaller shape than that of the wear resistant metal composite. In the latter case, wear resistance and strength can be enhanced only regarding a part of the wear resistant metal composite where formed fly ash is embedded.

Fly ash means fine particulate ash produced by combustion, including coal ash. Examples of fly ash are dust and coal ash which are accumulated in a blast furnace and a dust collecting furnace at an electric power company, a cast iron factory and the like. Fly ash is available at the very low cost. For this reason, the wear resistant metal composite can be manufactured at the low cost.

In addition, fly ash has generally a particle size of 0.1 $\mu$m to several hundreds $\mu$m. In order to obtain the uniform properties of the wear resistant metal composite, fly ash is preferably used by classifying into an appropriate size before forming.

For example, when a particle size of fly ash is 1 to 100 $\mu$m, such a sliding surface is obtained that aggregation of fly ash is small and aggression of the metal composite against a counterpart member is also small.

On the other hand, when a particle size of fly ash is not greater than 1 $\mu$m, aggregation of fly ash occurs during forming fly ash, which may leads to unevenness on the sliding surface. In addition, when a particle size of fly ash exceeds 100 $\mu$m, aggression of the metal composite against a counterpart member is increased, which may lead to increase in wear of the counterpart member.

In addition, fly ash is exposed on the surface of the wear resistant metal composite. Fly ash is harder than a metal. For this reason, fly ash supports pushing pressure of the counterpart member to suppress a wear amount of the metal and prevent seizure on the sliding surface.

The formed fly ash preferably contains an inorganic fiber in the interior thereof. This can improve formability of the formed fly ash while maintaining wear resistance of the wear resistant metal composite.

The inorganic fiber is preferably any of alumina fiber and alumina-silica fiber. This can further enhance strength and wear resistance of the wear resistant metal composite.

The metal is preferably one or more selected from the group consisting of aluminium (Al), magnesium (Mg) and copper (Cu). This can afford a wear resistant metal composite which is cheap and light.

EMBODIMENTS

Embodiment 1

Figure 1:
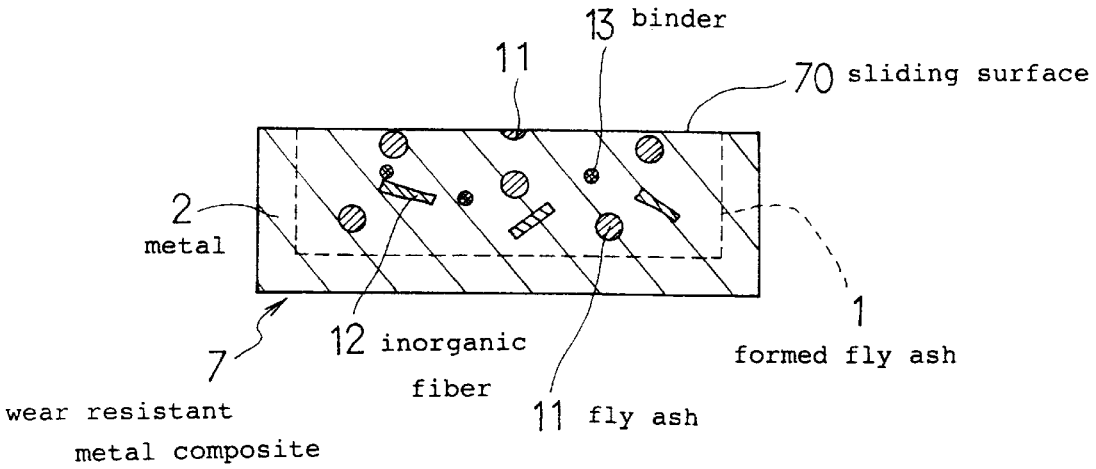
FIG. 1 is a cross-sectional view illustrating a wear resistant metal composite in Embodiment 1 and Experiment.
Figure 2:
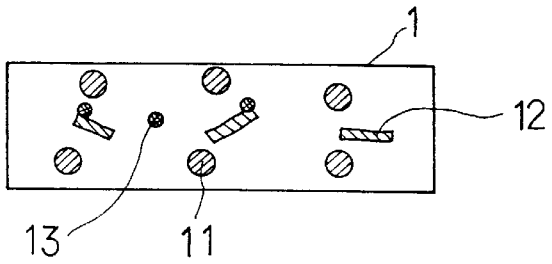
FIG. 2 is a view illustrating a process for manufacturing formed fly ash in Embodiment 1.

Embodiments of the present wear resistant metal composite are explained with reference to FIGS. 1–3.

The present wear resistant metal composite 7 comprises formed porous fly ash 1 obtained by forming fly ash 11 and a metal 2 impregnated in voids in the interior of the formed fly ash 1. Surface cutting has been done on the sliding surface 70 of the wear resistant metal composite 7, to a degree that fly ash 11 is exposed on the surface.

The wear resistant metal composite 7 comprises 20% by volume of formed fly ash 1 and 80% by volume of a metal 2.

Formed fly ash 1 comprises fly ash 11, binder 13, and an inorganic fiber 12. Fly ash has the components of 25% by weight of Al2O3, 60% by weight of SiO2, 5% by weight of Fe2O3, 2% by weight of CaO, and 8% by weight of others (MgO, K2O5, Na2O, TiO2). As the inorganic fiber 12, alumina fiber is used.

The metal 2 is aluminium diecast alloy (JIS specification ADC12).

Then, a process for manufacturing the wear resistant metal composite will be explained.

First, fly ash was taken from a dust collector or the like, and classified into particle size of 1 to 40 $\mu$m. Then, as shown in FIG. 2, an amount of fly ash 11 and the same amount of inorganic fiber 12 were mixed, and this mixture was formed into disk-like shape by, for example, a slurry method to obtain formed fly ash 1.

Figure 3:
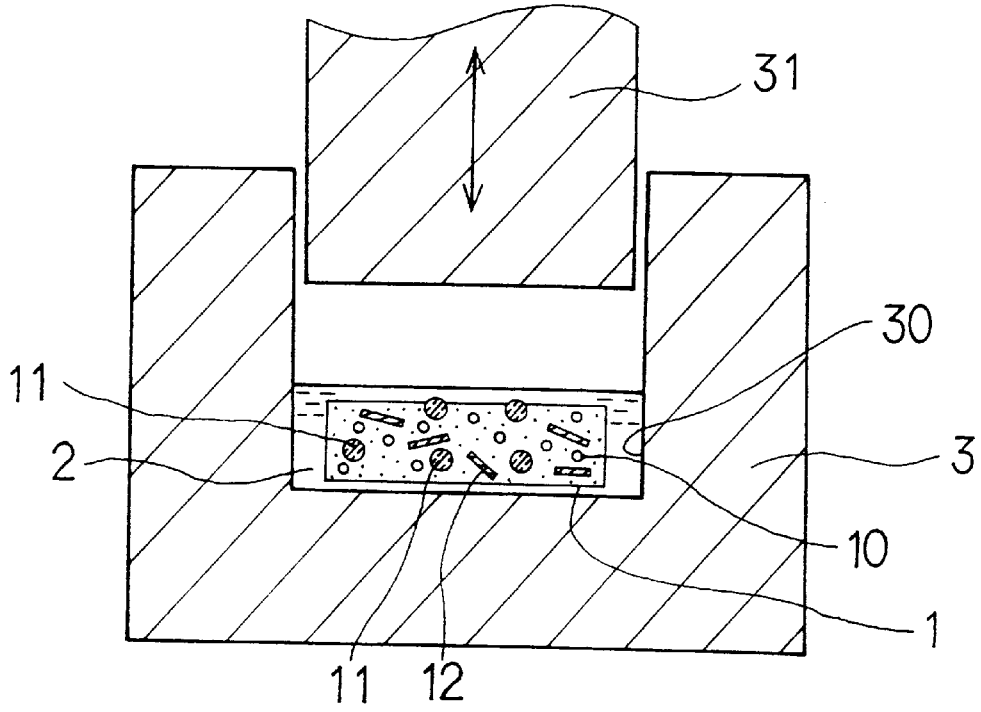
FIG. 3 is a view illustrating a process for casting a wear resistant metal composite in Embodiment 1.

Then, as shown in FIG. 3, formed fly ash 1 was disposed into the cavity 30 of a mold 3. Then, molten metal 2 was cast into the cavity 30, and pressure of 600 kg/cm2 was applied thereto with an upper side half 31 from above the cavity 30. This immersed 80% by volume of aluminium diecast alloy into 20% by volume of formed fly ash to obtain the wear resistant metal composite.

Embodiment 2

In this Embodiment, formed fly ash comprising 15 parts by volume fly ash and 5 parts by volume of alumina fiber was used. 80% by volume of aluminium diecast was impregnated in 20% by volume of formed fly ash.

Other conditions are the same as those in Embodiment 1.

Embodiment 3

In this Embodiment, formed fly ash was obtained by using fly ash without the addition of alumina fiber. 70% by volume of aluminium diecast alloy was impregnated in 30% by volume of formed fly ash.

Other conditions are the same as those in Embodiment 1.

Embodiment 4

In this Embodiment, formed fly ash comprising 15 parts by volume of fly ash and 5 parts by volume of alumina-silica fiber was used. 80% by volume of aluminium diecast was impregnated in 20% by volume of formed fly ash.

Other conditions are the same as those in Embodiment 1.

(Comparative Example)

A wear resistant metal composite in this Comparative Example was obtained by impregnating 90% by volume of aluminium diecast alloy (JIS specification ADC 12) in 10% by volume of alumina fiber without the use of fly ash.

(Experiment)

In this Experiment, the wear resistant metal composites described above were evaluated for their wear resistant properties.

Upon evaluation of wear resistant properties, a lubricating oil was coated on the wear resistant metal composites of the above various Embodiments 1–4 and Comparative Example. Excess lubricating oil was wiped off. Then, coefficient of friction, wear amount and a seizure time of the sliding surface of the wear resistant metal composites were measured.

Figure 4:
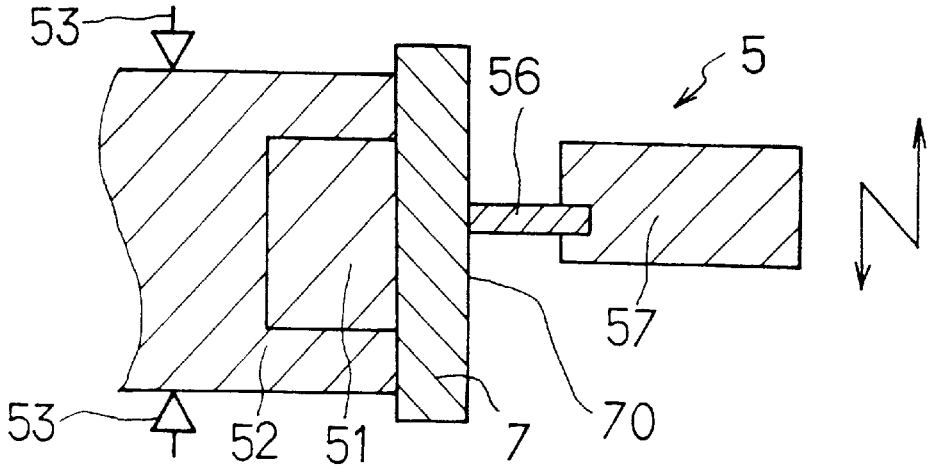
FIG. 4 is a view illustrating a vertical type reciprocating wear testing machine in Experiment.

Upon measurement, a vertical type reciprocating sliding wear testing machine 5 shown in FIG. 4 was used. That is, the wear resistant metal composite 7 was fixed to a fixing equipment 52, followed by heating at 100° C. with a heater 51. A reciprocating counterpart member 56 was slid on the sliding surface 70 of this wear resistant metal composite 7 at a pushing load of 20 N. The counterpart member 56 was fixed with a holder 57 and reciprocated at a sliding rate of 200/min. As the counterpart member 56, a material mimicking a piston ring comprising SWOSC-V (JIS specification) plated with chromiumwas used. A load received by the fixing equipment 52 from the wear resistant metal composite 7 was detected by a load cell 53. Form the detected load, coefficient of friction of the wear resistant metal composite 7 was obtained.

In addition, change in weight before and after the wear test on the wear resistant metal composite was measured and, from the difference, a wear amount of the wear resistant metal composite due to sliding was obtained. A sliding time for sliding the counterpart member against the sliding surface of the wear resistant metal composite was 76 minutes. In addition, a wear amount of the counterpart member was obtained similarly.

In addition, using the vertical reciprocating sliding wear testing machine, the counterpart member was slid against the sliding surface of the wear resistant metal composite and a time until seizure of the sliding surface was measured. The sliding conditions were the same as those for measuring coefficient of friction.

The composition of the wear resistant metal composites of Embodiments 1–4 and Comparative Example are shown in Table 1.

As shown in Table 1, the wear resistant metal composites of the present invention (Embodiments 1–4) had low coefficient of friction of 0.07 to 0.08. In addition, a wear amount of the wear resistant metal composites was low as not greater than 5.2 mg. It took a long time until the sliding surface of the wear resistant metal composite was seized.

Like this, the grounds why the wear resistant metal composites of the present invention have the excellent properties as described above can be considered as follow. That is, as shown in FIG. 1, since a part of fly ash 11 which is a hard material and that of an inorganic fiber 12 are exposed and dispersed on the sliding surface 70 in the wear resistant metal composite 7, they support a load of the counterpart member 56. For this reason, a wear amount of the wear resistant metal composites is small. In addition, since the counterpart member 56 is prevented from directly contacting with aluminum diecast alloy in the aluminium matrix, seizure on the sliding surface 70 is not caused and coefficient of friction is small and stable.

In the cylinder part 74 of the engine block 72, a piston 79 with a piston ring 791, which is a counter member, attached thereto reciprocates. The piston ring 791 slides against the sliding surface 70 of the cylinder part 74. The reciprocating movement 791 of the piston 79 is transmitted to each actuating part through a rod (not shown) arranged in the interior of the lower part 75 of the engine block 72.

TABLE 1

| | the composition of a metal composite (volume %) | | wear amount of a metal | wear amount of a counterpart | coefficient friction | seizure |
|---|---|---|---|---|---|---|
| | non-metallic component | ADC12 | composite (mg) | member | of a metal composite | time |
| embodiment 1 | FA* 10, alumina fiber 10 | 80 | 5.2 | 0.3 | 0.07~0.08 | ≧76 minutes |
| embodiment 2 | FA* 15, alumina fiber 5 | 80 | 3.0 | 0.1 | 0.07~0.08 | ↑ |
| embodiment 3 | FA* 30 | 70 | 3.1 | 0.1 | 0.06~0.07 | ↑ |
| embodiment 4 | FA* 15, alumina-silica fiber 5 | 80 | 4.8 | 0.4 | 0.07~0.08 | ↑ |
| comparative example | alumina fiber 10 | 90 | 12.0 | 0.2 | 0.08~0.23 | 65 minutes |

※FA*: Fly Ash

Embodiment 5

This Embodiment is an application example where the wear resistant metal composite of the present invention is applied to a part of an engine block of an internal combustion engine.

Figure 5:
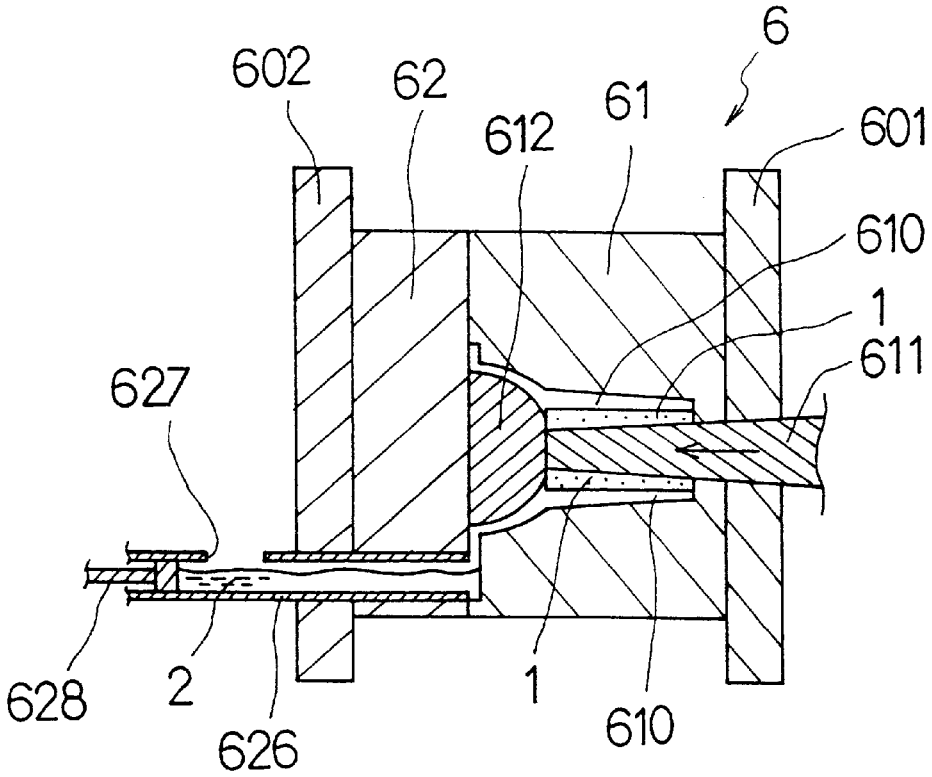
FIG. 5 is a view illustrating a process for casting an engine block in Embodiment 5.

A process for manufacturing the engine block is explained. First, a mold 6 for casting the engine block, which is used for casting a diecast is prepared as shown in FIG. 5. The mold 6 comprises a stationary half 62 and a movable half 61 and the cavity 610 is provided in the interior of them. In addition, the stationary half 62 and the movable half 61 are supported by supports 602 and 601.

The cavity 610 is provided with cores 611 and 612 for forming a cylinder part and a lower part. The core 611 for forming the cylinder part is fixed to the movable half 61. The core 612 for forming a lower part is fixed to the stationary half 62. A casting inlet 627 for casting molten metal 2 is open in the stationary half 62.

On the the hand, fly ash and an inorganic fiber are mixed as in Embodiment 1 and formed to obtain formed fly ash 1. Formed fly ash 1 is in the form of a cylinder and has an inner diameter having approximately same shape as that of the cylinder part of the engine block.

Next, formed fly ash 1 is fitted to the core 611 for forming the cylinder part.

Then, molten metal 2 is cast into an extruding pipe 626 through the casting inlet 627 of the stationary half 62. Pressure is slowly applied with a pressurizing piston 628 to cast molten metal 2 in the extruding pipe 626 into the cavity 610. After molten metal 2 is filled into almost whole of the cavity 610, the pressuring piston 628 is further pushed therein to pressurize molten metal 2 (not shown in figure).

This pressurizing impregnates the molten metal 2 filled in the cavity 610 in the interior of the voids of formed fly ash 1. Then, the metal 2 is solidified.

This forms a cast engine block comprising a wear resistant metal composite in the cavity 610.

Figure 6:
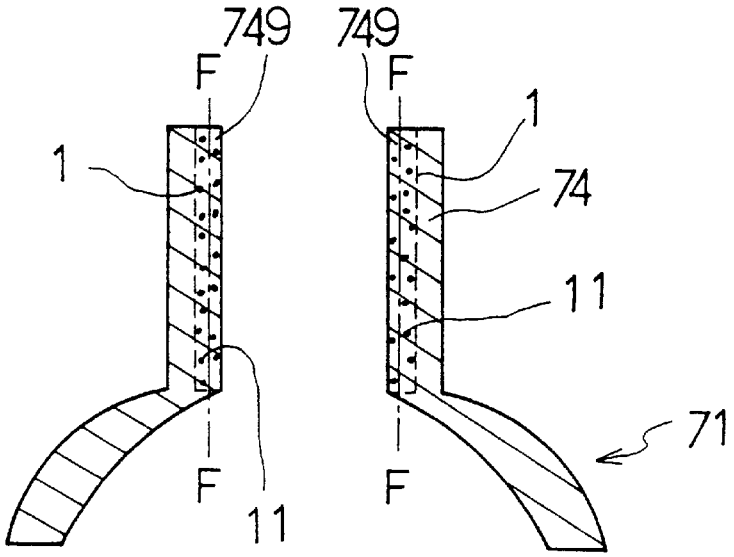
FIG. 6 is a view illustrating a cast engine block in Embodiment 5.

After the metal is solidified, the cast engine block 71 is removed from the cavity as shown in FIG. 6. Then, an inner diameter part 749 of a cylinder part 74 is cut along F—F line shown in FIG. 6 and, at the same time, the cut part is abraded. This affords an engine block 72 in which fly ash 11 is exposed on the sliding surface 70 of the cylinder part 74.

Since fly ash 11 is exposed on the sliding surface 70 in the engine block 72 in this Embodiment, a wear amount is small. In addition, fly ash 11 exposed on the sliding surface 70 prevents aluminium diecast alloy of the cylinder part 74 and the piston ring 791 from directly contacting, seizure dose not occur on the sliding surface 70 and coefficient of friction on the sliding surface 70 is small and stable.

In addition, as shown in FIG. 5, the formed fly ash 1 which is a reinforcer is pre-formed into the cylindrical shape, the formed fly ash 1 is fitted to the core 611 and pressure casting is performed with a diecast. Therefore, engine blocks are easily cast.

In addition, since fly ash is light and cheap, light engine blocks can be obtained at the lower cost.

Figure 7:
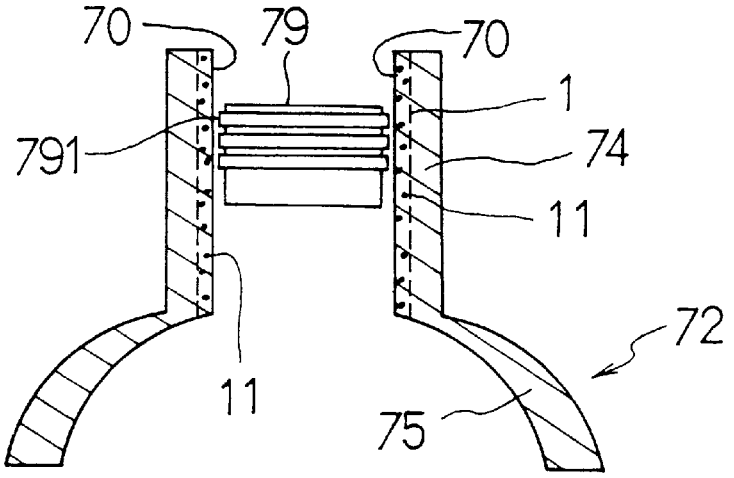
FIG. 7 is a view illustrating an engine block in Embodiment 5.

In addition, since formed fly ash is arranged in the interior of the wear resistant metal composite at the arbitrary shape and density by impregnating molten metal using formed fly ash, strength of the engine block 72, in particular, of the cylinder part 74 which receives sliding from the piston ring 791 can be improved as shown in FIG. 7.

What is claimed is:

1. A wear resistant metal composite which comprises formed porous fly ash obtained by forming fly ash into the desired shape and a metal impregnated into voids present in the interior of said formed fly ash, wherein the percentage by volume of said formed fly ash is 30% by volume or less and wherein said fly ash is exposed on the surface of said resistant metal composite, and wherein the formed fly ash contains an inorganic fiber in the interior thereof.

2. The wear resistant metal composite according to claim 1, wherein the inorganic fiber is selected from the group consisting of alumina fiber and alumina-silica fiber.

3. The wear resistant metal composite according to claim 1, wherein the metal is one or more selected from the group consisting of aluminium (Al), magnesium (Mg) and copper (Cu).

4. The wear resistant metal composite according to claim 1, where the percentage by volume of said formed fly ash is less than 30% by volume.

5. The wear resistant metal composite according to claim 1, where the percentage by volume of said formed fly ash is 20% by volume.

* * * * *